US012487018B2

(12) United States Patent
Ryu et al.

(10) Patent No.: US 12,487,018 B2
(45) Date of Patent: Dec. 2, 2025

(54) SYSTEMS AND METHODS FOR DETECTING FAILURE MODES OF AN ICE MAKER APPLIANCE

(71) Applicant: Haier US Appliance Solutions, Inc., Wilmington, DE (US)

(72) Inventors: Choonjae Ryu, Prospect, KY (US); Jason Andrew May, Anchorage, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 231 days.

(21) Appl. No.: 18/339,605

(22) Filed: Jun. 22, 2023

(65) Prior Publication Data

US 2024/0426535 A1 Dec. 26, 2024

(51) Int. Cl.

| | |
|---|---|
| ***F25C 5/20*** | (2018.01) |
| *F25C 5/18* | (2018.01) |
| *F25C 5/182* | (2018.01) |

(52) U.S. Cl.

CPC ..... *F25C 5/22* (2018.01); *F25C 5/18* (2013.01); *F25C 5/182* (2013.01); *F25C 2600/04* (2013.01); *F25C 2700/00* (2013.01); *F25C 2700/02* (2013.01)

(58) Field of Classification Search

CPC ..... F25C 5/22; F25C 5/24; F25C 5/182

See application file for complete search history.

(56) References Cited

U.S. PATENT DOCUMENTS

| | | | | |
|---|---|---|---|---|
| 10,563,898 | B2 | 2/2020 | Park | |
| 10,663,205 | B2 | 5/2020 | Brewer et al. | |
| 2015/0059394 | A1* | 3/2015 | Gomes | F25C 5/06 62/340 |

FOREIGN PATENT DOCUMENTS

| | | | |
|---|---|---|---|
| EP | 1930673 | B1 | 6/2020 |

* cited by examiner

*Primary Examiner* — Elizabeth J Martin

(74) *Attorney, Agent, or Firm* — Dority & Manning, P.A.

(57) ABSTRACT

A method for operating an ice maker appliance includes a step of directing a fill of liquid water to compartments of an ice tray. The method also includes a step of operating a harvest mechanism to harvest ice pieces formed within the compartments of the ice tray. The method may further include a step of sensing, with a sensor assembly, conditions of an ice storage bin. The method may also include a step of determining, based on the sensed conditions of the ice storage bin, an amount of ice pieces harvested from the ice tray. The method may further include a step of detecting, based on the determined amount of ice pieces harvested, a failure mode of the ice tray.

18 Claims, 9 Drawing Sheets

SYSTEMS AND METHODS FOR DETECTING FAILURE MODES OF AN ICE MAKER APPLIANCE

FIELD

The present subject matter relates generally to an ice maker appliance, and more particularly to systems and methods for detecting ice piece release failures and ice tray failures in such appliances.

BACKGROUND

Certain refrigerator appliances include an ice maker. An ice maker may also be a stand-alone appliance designed for use in commercial and/or residential kitchens. To produce ice, liquid water is directed to the ice maker and frozen. For example, certain ice makers include an ice tray, for example, a mold body for receiving liquid water. After ice is formed in the ice tray, it may be harvested from the ice tray and stored within an ice storage bin within the refrigerator appliance.

In some instances, an ice piece may not be properly harvested from the ice tray, for instance, may not be released from the ice tray after the ice piece has formed. This may result in formed ice pieces remaining stuck in the ice tray and not being collected and stored within the ice storage bin. In other instances, an amount of liquid water may escape from the ice tray, such as through a crack in the ice tray, prior to ice forming within the ice tray. This may result in ice pieces not forming, or only partially forming, within the ice tray. Such instances may consequently result in failure modes of the ice maker, for example, modes or conditions of the ice maker when improper function of the ice maker occurs.

Accordingly, an improved ice maker that is configured to detect failure modes is desired. More specifically, an ice maker that includes features and operations that may be utilized to detect and respond to failure modes of the ice maker would be particularly beneficial.

BRIEF DESCRIPTION

Aspects and advantages of the invention will be set forth in part in the following description, or may be apparent from the description, or may be learned through practice of the invention.

In one exemplary embodiment, a method for operating an ice maker appliance may be provided. The method may include a step of directing a fill of liquid water to compartments of an ice tray. The method may also include a step of operating a harvest mechanism to harvest ice pieces formed within the compartments of the ice tray. The harvested ice pieces may be collected within an ice storage bin. The method may further include a step of sensing, with a sensor assembly, conditions of the ice storage bin. The method may also include a step of determining, based on the sensed conditions of the ice storage bin, an amount of ice pieces harvested from the ice tray. The method may further include a step of detecting, based on the determined amount of ice pieces harvested, a failure mode of the ice tray.

In another exemplary embodiment, an ice maker appliance is provided. The ice maker appliance may include an ice tray that may define one or more compartments. Each compartment of the ice tray may be configured to hold an ice piece. The ice maker appliance may also include a harvest mechanism that may be configured to harvest ice pieces from the ice tray. The ice maker appliance may further include an ice storage bin that may be provided to collect ice pieces harvested from the ice tray. The ice maker appliance may also include a sensor assembly that may be attached to the ice storage bin. Conditions of the ice storage bin may be sensed by the sensor assembly. The ice maker appliance may further include a controller. The controller may be operable for: directing a fill of liquid water to the one or more compartments of the ice tray; operating the harvest mechanism to harvest ice pieces formed within the one or more compartments of the ice tray; sensing, with the sensor assembly, conditions of the ice storage bin; determining, based on the sensed conditions of the ice storage bin, an amount of ice pieces harvested from the ice tray; and detecting, based on the determined amount of ice pieces harvested, a failure mode of the ice tray.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
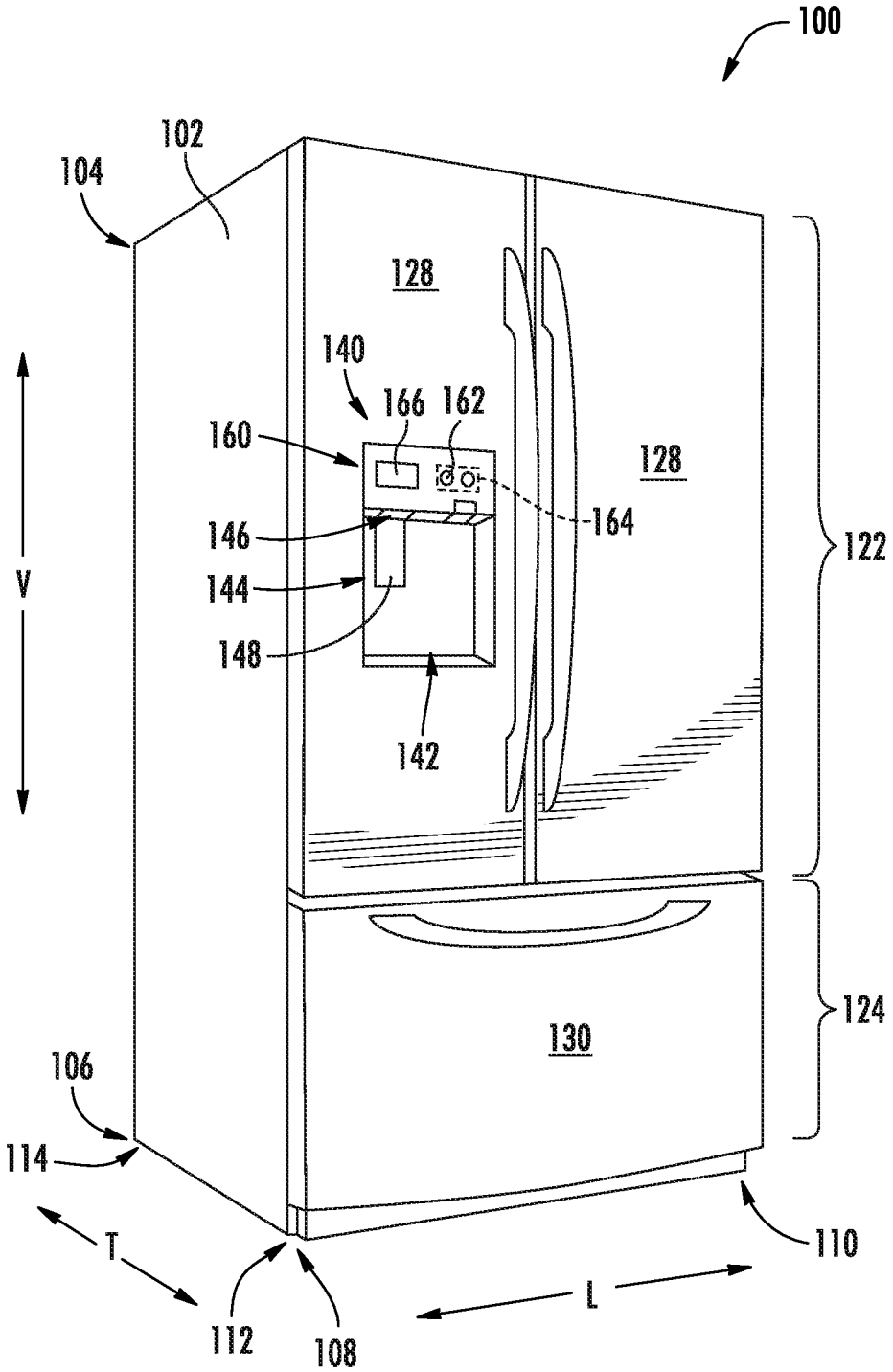
FIG. 1 provides a perspective view of a refrigerator appliance according to one or more exemplary embodiments of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both").

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a ten percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise, or counterclockwise, with the vertical direction V.

FIG. 1 provides a perspective view of a refrigerator appliance 100 according to one or more exemplary embodiments of the present subject matter. The refrigerator appliance 100 may define a vertical direction V, a lateral direction L, and a transverse direction T. Each of the vertical direction V, lateral direction L, and transverse direction T being mutually perpendicular to one another to form an orthogonal coordinate system. Refrigerator appliance 100 may include a cabinet or housing 102 that may extend between a top 104 and a bottom 106 approximately along the vertical direction V, between a first side 108 and a second side 110 approximately along the lateral direction L, and between a front side 112 and a rear side 114 approximately along the transverse direction T.

Housing 102 may define one or more chilled chambers for receipt of food items for storage. In particular, housing 102 may define a fresh food chamber 122 positioned at or adjacent top 104 of housing 102 and a freezer chamber 124 arranged at or adjacent bottom 106 of housing 102. As such, the refrigerator appliance 100 may generally be referred to as a bottom mount refrigerator. It is recognized, however, that the benefits of the present disclosure apply to other types and styles of refrigerator appliances such as, e.g., a top mount refrigerator appliance, a side-by-side style refrigerator appliance, or a single door refrigerator appliance. Consequently, the description set forth herein may be for illustrative purposes only and is not intended to be limiting in any aspect to any particular refrigerator chamber configuration.

The refrigerator appliance 100 may include refrigerator doors 128 that may be rotatably hinged to an edge of housing 102 for selectively accessing the fresh food chamber 122. In addition, a freezer door 130 may be arranged below the refrigerator doors 128 for selectively accessing the freezer chamber 124. Freezer door 130 may be coupled to a freezer drawer (not shown) that may be slidably mounted within freezer chamber 124. Refrigerator doors 128 and freezer door 130 may be shown in the closed configuration in FIG. 1. One skilled in the art will appreciate that other chamber and door configurations are possible and within the scope of the present invention.

Figure 2:
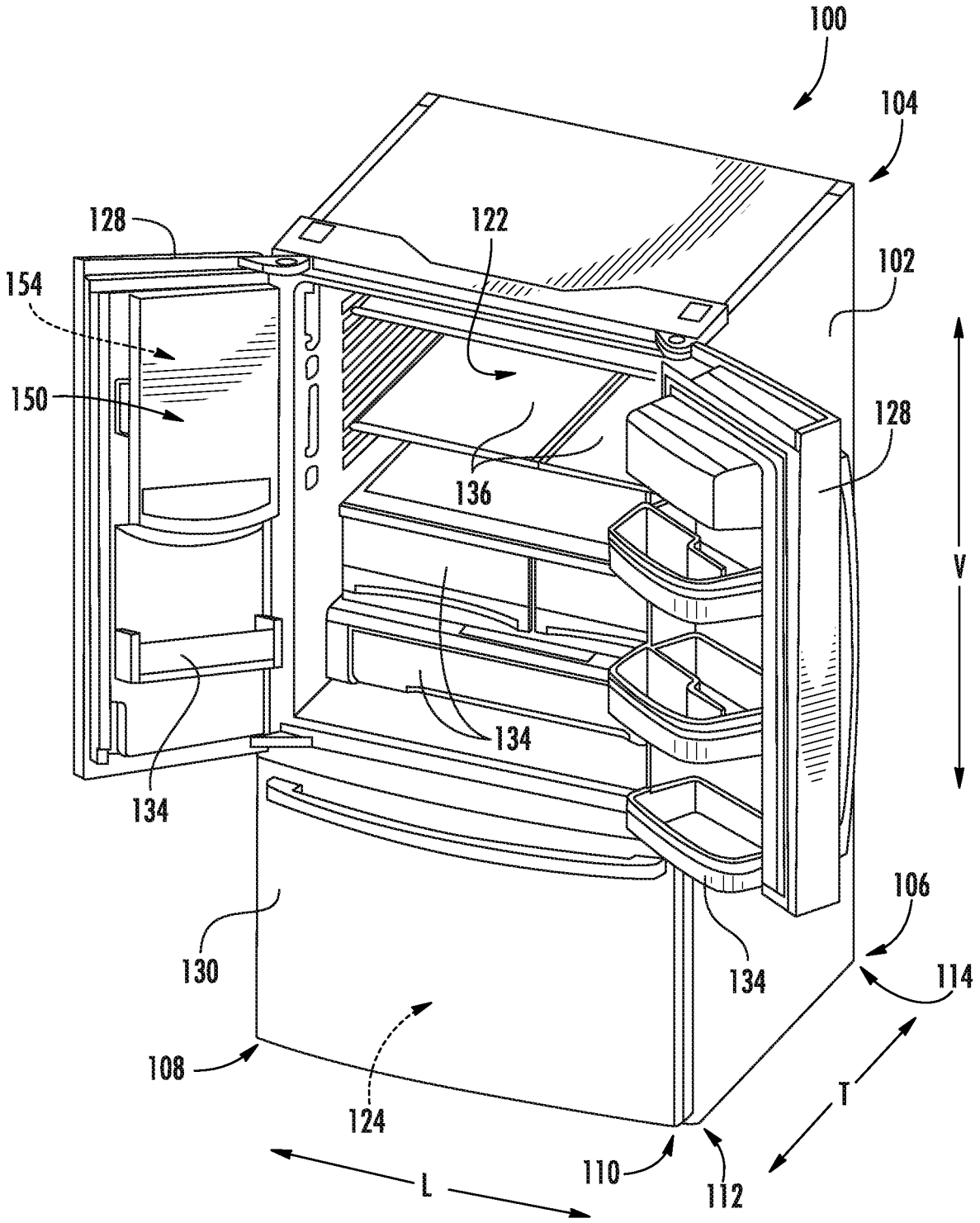
FIG. 2 provides a perspective view of the exemplary refrigerator appliance of FIG. 1, with the doors of the fresh food chamber shown in an open position.

Referring now to FIG. 2, a perspective view of the refrigerator appliance 100 shown with the refrigerator doors 128 in the open position is provided. As shown in FIG. 2, various storage components may be mounted within fresh food chamber 122 to facilitate storage of food items therein as will be understood by those skilled in the art. In particular, the storage components may include bins 134 and shelves 136. Each of these storage components are configured for receipt of food items (e.g., beverages and/or solid food items, etc.) and may assist with organizing such food items. As illustrated, bins 134 may be mounted on refrigerator doors 128 or may slide into a receiving space in fresh food chamber 122. It should be appreciated that the illustrated storage components are used only for the purpose of explanation and that other storage components may be used and may have different sizes, shapes, and configurations.

Referring now generally to FIG. 1, a dispensing assembly 140 will be described according to exemplary embodiments of the present subject matter. Dispensing assembly 140 may generally be configured for dispensing liquid water and/or ice pieces. Although an exemplary dispensing assembly 140 may be illustrated and described herein, it should be appreciated that variations and modifications may be made to dispensing assembly 140 while remaining within the present subject matter.

Dispensing assembly 140 and its various components may be positioned at least in part within a dispenser recess 142 defined on one of refrigerator doors 128. In this regard, dispenser recess 142 is defined on a front side 112 of refrigerator appliance 100 such that a user may operate dispensing assembly 140 without opening refrigerator door 128. In addition, dispenser recess 142 may be positioned at a predetermined elevation convenient for a user to access ice and enabling the user to access ice without the need to bend-over. In the exemplary embodiment, dispenser recess 142 may be positioned at a level that approximates the chest level of a user.

Dispensing assembly 140 may include an ice dispenser 144 that may include a discharging outlet 146 for discharging ice pieces from dispensing assembly 140. An actuating mechanism 148, shown as a paddle, may be mounted below discharging outlet 146 for operating ice or water dispenser 144. Discharging outlet 146 and actuating mechanism 148 may be an external part of the ice dispenser 144 and may be mounted in dispenser recess 142.

In alternative exemplary embodiments, any suitable actuating mechanism may be used to operate ice dispenser 144. For example, ice dispenser 144 can include a sensor (such as an ultrasonic sensor) or a button rather than the paddle.

Figure 3:
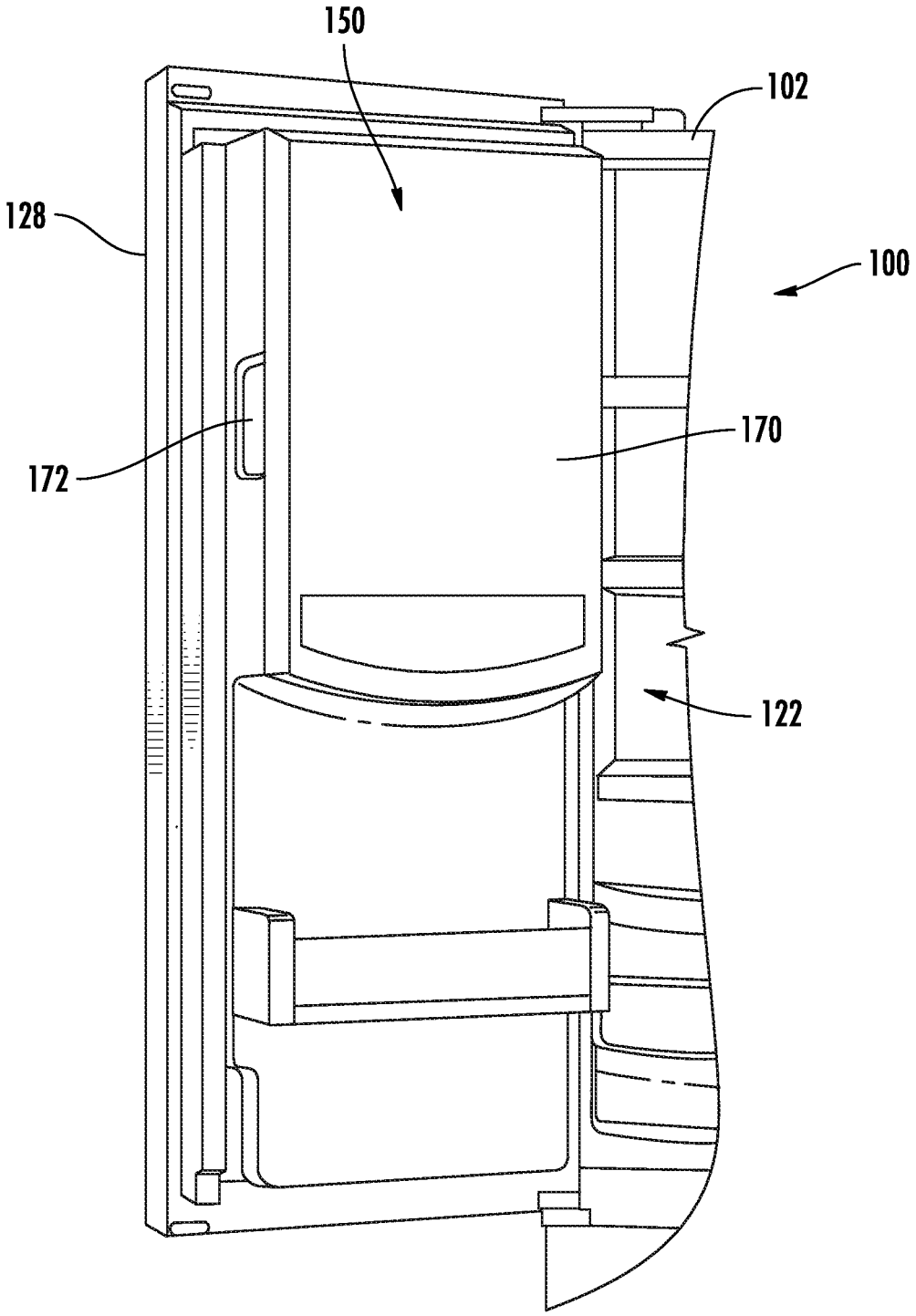
FIG. 3 provides an interior perspective view of a dispenser door of the exemplary refrigerator appliance of FIG. 1.
Figure 4:
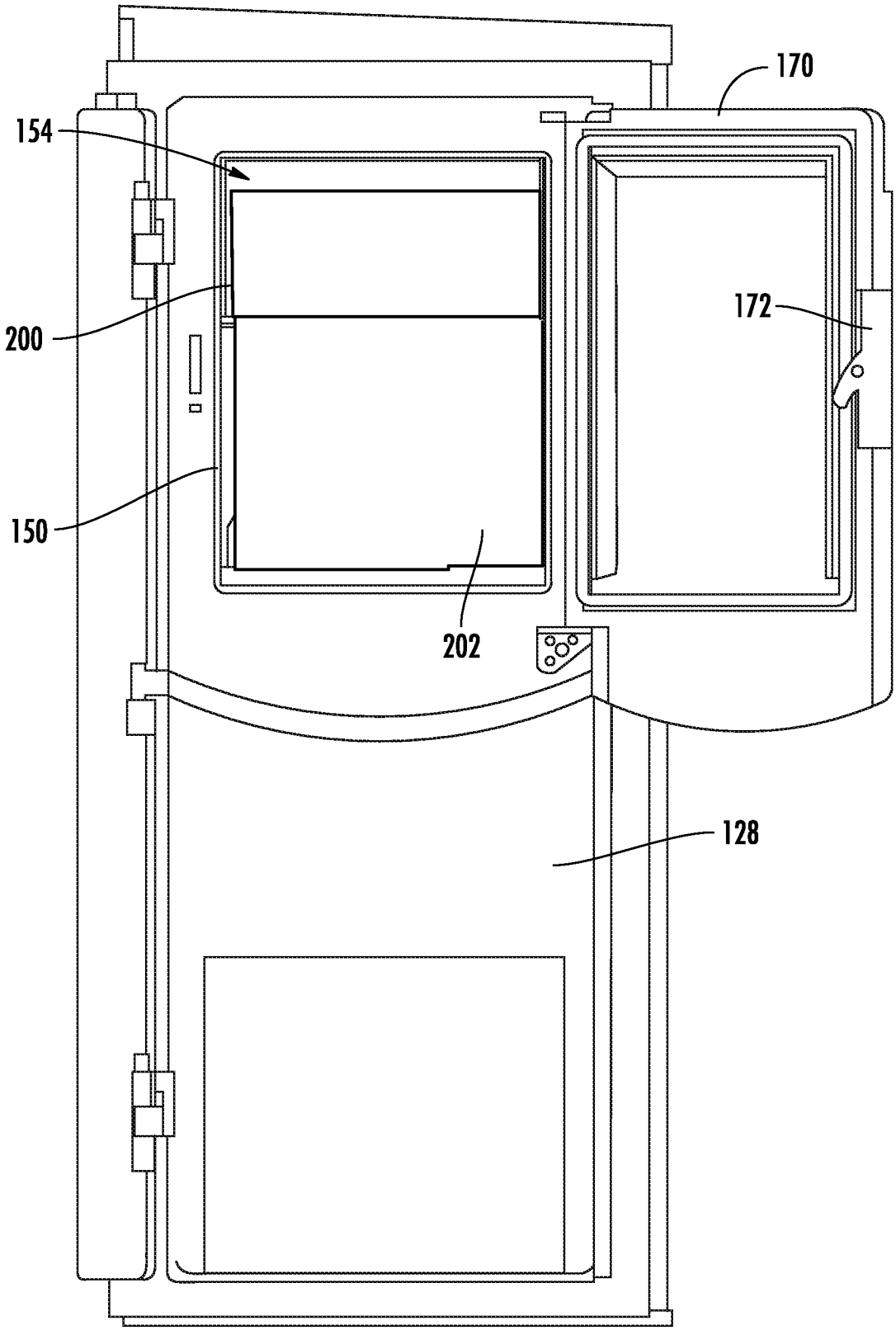
FIG. 4 provides an interior elevation view of the door of FIG. 3 with an access door of the dispenser door shown in an open position.

By contrast, inside refrigerator appliance 100, refrigerator door 128 may define an icebox 150, see, for example, FIGS. 2 through 4, that may house an ice maker 200 and an ice storage bin 202 that may be configured to supply ice pieces to dispenser recess 142. In this regard, for example, the icebox 150 may define an ice making chamber 154 for housing an ice making assembly, a storage mechanism, and a dispensing mechanism.

A control panel 160 may be provided for controlling the mode of operation. For example, control panel 160 may include one or more selector inputs 162, such as knobs, buttons, touchscreen interfaces, for selecting a desired mode of operation, for example an ice-dispensing button that may be provided for selecting crushed or non-crushed ice pieces. In addition, the one or more selector inputs 162 may be used to specify a fill volume or method of operating dispensing assembly 140. In this regard, the one or more selector inputs 162 may be in communication with a processing device or controller 164. Signals generated in controller 164 may operate the refrigerator appliance 100 and the dispensing assembly 140 in response to the one or more selector inputs 162. Additionally, a display 166, such as an indicator light or a screen, may be provided on control panel 160. Display 166 may be in communication with controller 164 and may display information in response to signals from controller 164.

As used herein, "processing device" or "controller" may refer to one or more microprocessors or semiconductor devices and is not restricted necessarily to a single element. The processing device can be programmed to operate refrigerator appliance 100 and dispensing assembly 140. The processing device may include, or be associated with, one or more memory elements (e.g., non-transitory storage media). In some such embodiments, the memory elements include electrically erasable, programmable read only memory (EEPROM). Generally, the memory elements can store information accessible to the processing device, including instructions that can be executed by processing device. Optionally, the instructions can be software or any set of instructions and/or data that when executed by the processing device, cause the processing device to perform operations.

Referring now to FIGS. 3 and 4, FIG. 3 provides an interior perspective view of one of the refrigerator doors 128 and FIG. 4 provides an interior elevation view of the refrigerator door 128 with an access door 170 shown in an open position. In some embodiments, the refrigerator appliance 100 may include an icebox 150, for example, a sub-compartment, that may be defined on one of the refrigerator doors 128. In the illustrated exemplary embodiment, the icebox 150 may extend into fresh food chamber 122 when refrigerator door 128 is in the closed position. As shown schematically in FIG. 4, an ice maker 200 may be positioned within the icebox 150. The ice maker 200 may generally be configured for freezing liquid water to form ice pieces, for example, ice cubes, which may be collected and stored in the ice storage bin 202 and which may be dispensed through discharging outlet 146 by dispensing assembly 140. FIG. 4 illustrates the ice maker 200 with an ice storage bin 202 positioned below the ice maker 200 for receiving ice pieces from the ice maker 200, e.g., for receiving the ice pieces after the ice pieces have been harvested from the ice maker 200, such as after the ice pieces have been released or ejected from the ice maker 200.

As those of ordinary skill in the art will recognize, ice pieces from the ice maker 200 may be collected and stored in the ice storage bin 202 and supplied to dispenser 144 (FIG. 1) from the ice storage bin 202 in icebox 150 on a back side of refrigerator door 128. Chilled air from a sealed system (not shown) of refrigerator appliance 100 may be directed into components within the icebox 150, e.g., ice maker 200 and/or ice storage bin 202.

As mentioned above, the present disclosure may also be applied to other types and styles of refrigerator appliances such as a top mount refrigerator appliance, a side-by-side style refrigerator appliance or a standalone ice maker appliance. Additionally, variations and modifications may be made to ice maker 200 while remaining within the scope of the present subject matter. Accordingly, the description herein of the icebox 150 on the refrigerator door 128 of the fresh food chamber 122 may be provided by way of example only. In other example embodiments, the ice maker 200 may be positioned in the freezer chamber 124, e.g., of the illustrated bottom-mount refrigerator, of a side by side refrigerator, of a top-mount refrigerator, or any other suitable refrigerator appliance. As another example, the ice maker 200 may also be provided in a standalone ice maker appliance. As used herein, the term "standalone ice maker appliance" may refer to an appliance of which the sole or primary operation is generating or producing ice, whereas the more general term "ice maker appliance" may include such appliances as well as appliances with diverse capabilities in addition to making ice, such as a refrigerator appliance equipped with an ice maker, among other possible examples.

As mentioned above, the access door 170 may be hinged to the inside of the refrigerator door 128. Access door 170 may permit selective access to the icebox 150. Any manner of suitable latch 172 may be configured with icebox 150 to maintain access door 170 in a closed position. As an example, latch 172 may be actuated by a user, such as a consumer, in order to open access door 170 for providing access into icebox 150. Access door 170 can also assist with insulating icebox 150, e.g., by thermally isolating or insulating icebox 150 from fresh food chamber 122.

Figure 5:
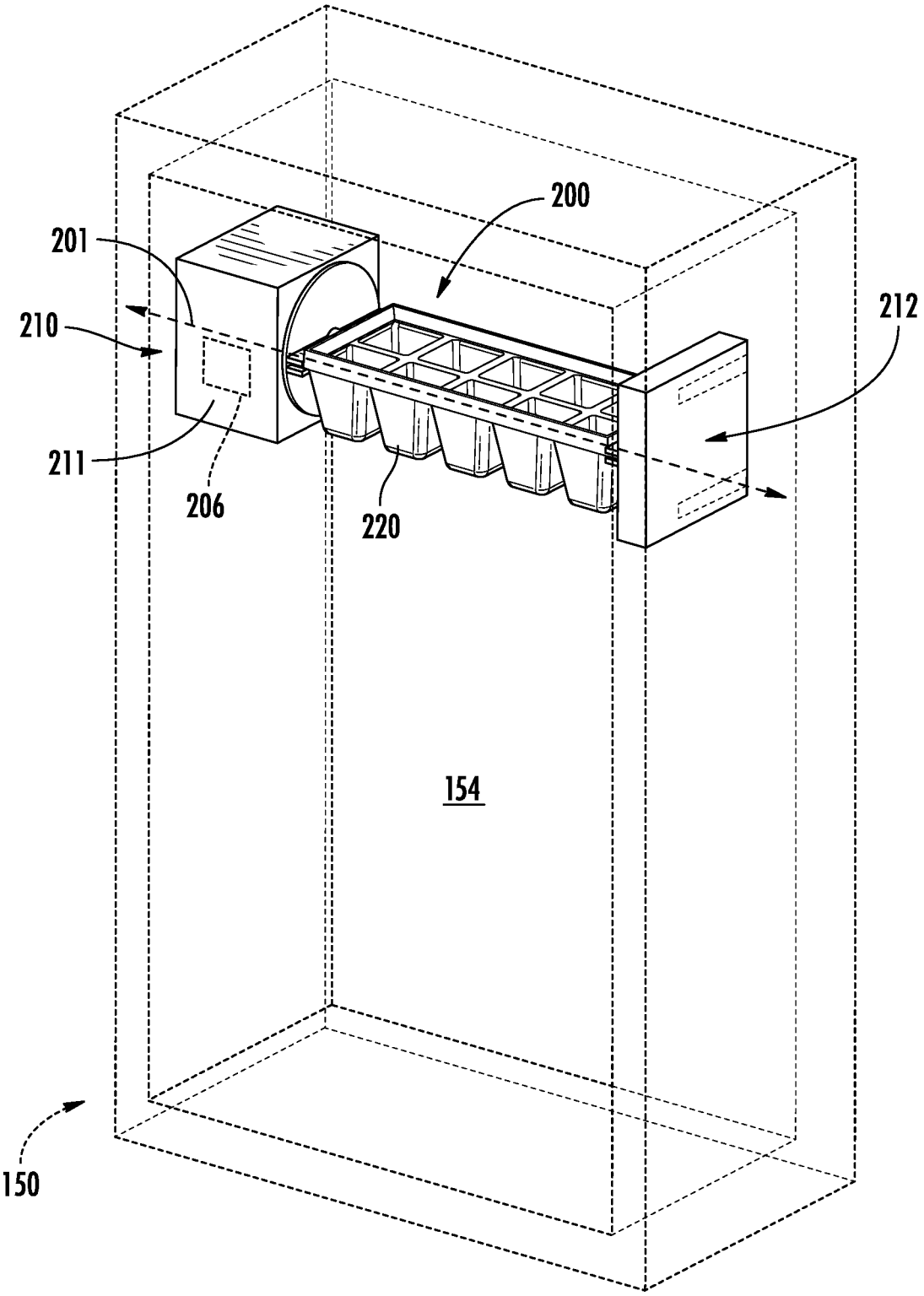
FIG. 5 provides a perspective view of an exemplary ice maker disposed in an icebox according to one or more embodiments of the present subject matter.
Figure 6:
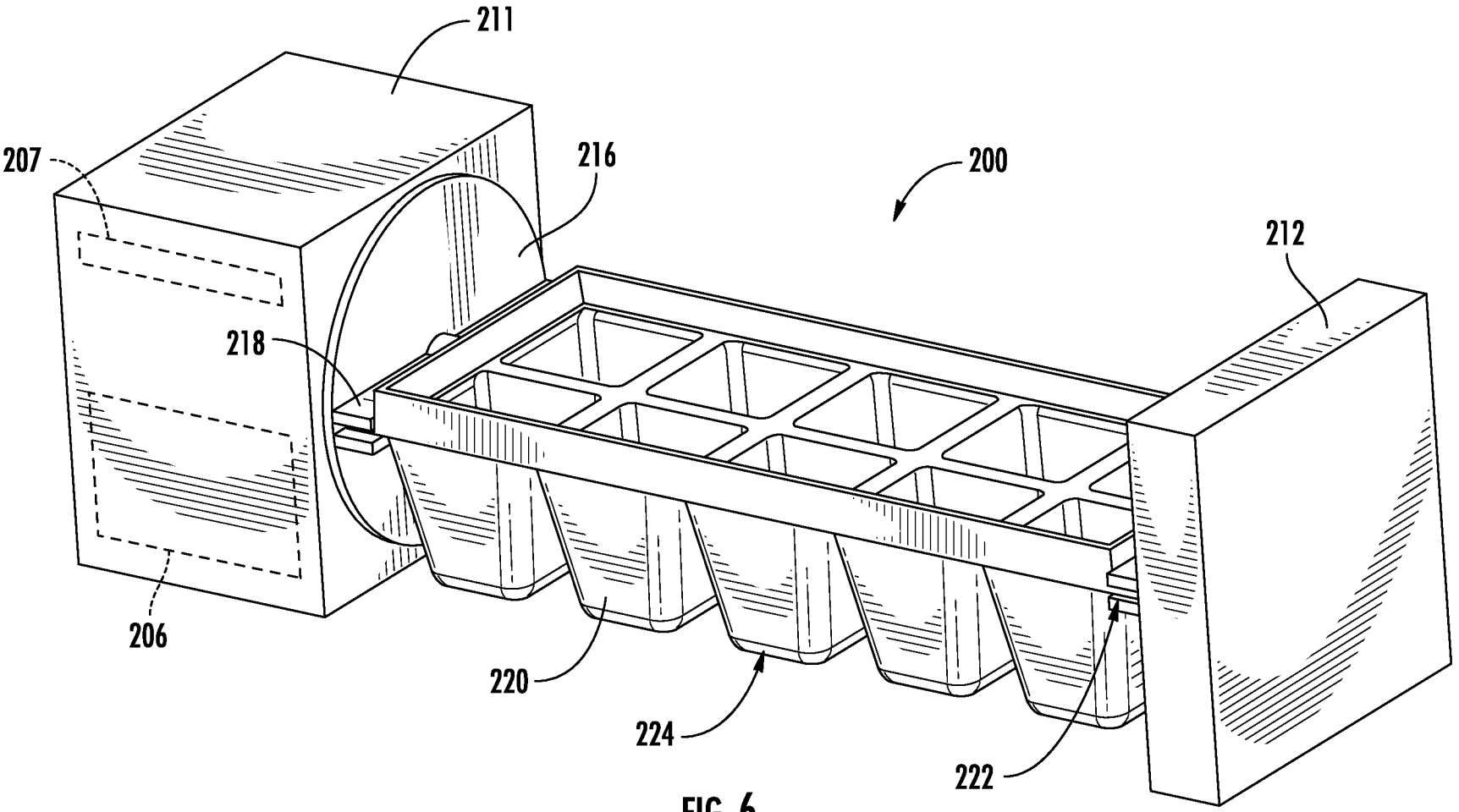
FIG. 6 provides another perspective view of the exemplary ice maker of FIG. 5.

Referring now to FIGS. 5 and 6, perspective views of one exemplary embodiment of the ice maker 200 are illustrated. In some embodiments, for example, as illustrated in FIGS. 5 and 6, the ice maker 200 may be a twist tray ice maker. In such embodiments, the ice maker 200 may include a mount unit 210 positioned in the icebox 150, e.g., mounted on one or more internal surfaces of the icebox 150. The mount unit 210 may be coupled to an ice tray 220, e.g., the mount unit 210 may be configured to releasably receive the ice tray 220. The ice tray 220 may provide a mold body of the ice maker 200, for instance, the ice tray 220 may include one or more compartments 224 for receiving liquid water therein. Typically, the liquid water may be retained within the compartment(s) 224 until ice may be formed (or at least a portion of the liquid water may be retained). The ice tray 220 may comprise a flexible, e.g., twistable, material, such as the ice tray 220 may comprise a plastic material which is sufficiently flexible to twist the ice tray 220 in order to promote disengagement, e.g., release, of ice pieces in the ice tray 220, as is understood by those of ordinary skill in the art.

In some embodiments, the mount unit 210 may include a first mount unit 211 and a second mount unit 212. The mount units 211, 212 may be spaced apart from one another along a central axis 201 of the ice maker 200. In various embodiments, a direction of the central axis 201 corresponds to, e.g., is along or parallel to, a longitudinal axis of the ice tray 220 when the ice tray 220 is installed to the mount unit 210. Furthermore, the mount units 211, 212 may be spaced apart from one another such as to allow a pair of lips 222, see, for example, FIG. 6, of the ice tray 220 separated along the central axis 201 to be received by respective mount units 211, 212. For example, the mount unit 210 may include one or more clips 218, e.g., a first clip 218 on the first mount unit 211 and a second clip 218 on the second mount unit 212, and the lip(s) 222 of the ice tray 220 may be configured to be received within and retained by the clip(s) 218, e.g., the lip(s) 222 may each be sized and shaped corresponding to a respective clip 218, such as the external dimensions of the lip 222 or each lip 222 may correspond to internal dimensions of the clip 218 or each clip 218, whereby the lip(s) 222 may be received within and retained by the clip(s) 218.

In various embodiments, the mount unit 210 may include a rotor 216 configured to rotate relative to a central axis 201. In such embodiments, the first clip 218 on the first mount unit 211 may be formed integrally with the rotor 216. The first mount unit 211 may be fixed to the icebox 150. The first mount unit 211 may include a motor or other actuation device 206 operably coupled to the rotor 216 to rotate relative to the central axis 201, e.g., about the central axis 201. When the ice tray 220 may be installed onto the rotor 216, rotation of the rotor 216, such as by the actuation device 206, causes the ice tray 220 to release, for instance, to dump or deposit, ice pieces or other contents from the ice tray 220.

In some embodiments, the ice maker 200 may include a dedicated controller 207, e.g., similar to the controller 164 of the refrigerator appliance 100 which is described above. In embodiments where the ice maker 200 is incorporated into a refrigerator appliance such as the exemplary refrigerator appliance 100 described hereinabove, the dedicated controller 207 may be in addition to the controller 164 of the refrigerator appliance 100 and may be in communication with the controller 164 of the refrigerator appliance 100, and the controller 207 of the ice maker 200 may be in operative communication with other components of the ice maker 200 and may be configured specifically for controlling or directing operation of such components, e.g., the actuation device 206. In some embodiments, the dedicated controller 207 of the ice maker 200 may be in operative communication with one or more sensors, such as a weight sensor or an impact sensor as will be described in more detail below.

For example, the controller 207 may control the rotation of the actuation device 206, for instance, the controller 207 may cause the actuation device 206 to rotate a first amount, e.g., through a first number of degrees about the central axis 201, to twist the ice tray 220 and thereby promote release of ice pieces from the compartment 224 thereof, such as rotating the first amount in a first direction followed by rotating the same amount, e.g., the first amount, in a second direction opposite the first direction to twist the ice tray 220 to release ice pieces from the compartments 224. After rotating the first amount, e.g., after twisting the ice tray 220, the controller 207 may then cause the actuation device 206 to rotate a second amount, e.g., through a second number of degrees about the central axis 201, greater than the first amount to tip over or invert the ice tray 220, allowing the ice pieces to be released, for example, fall, such as by gravity, from the ice tray 220 into the ice storage bin 202, see, for example, FIGS. 7 and 8, that may be positioned below the ice maker 200.

Figure 7:
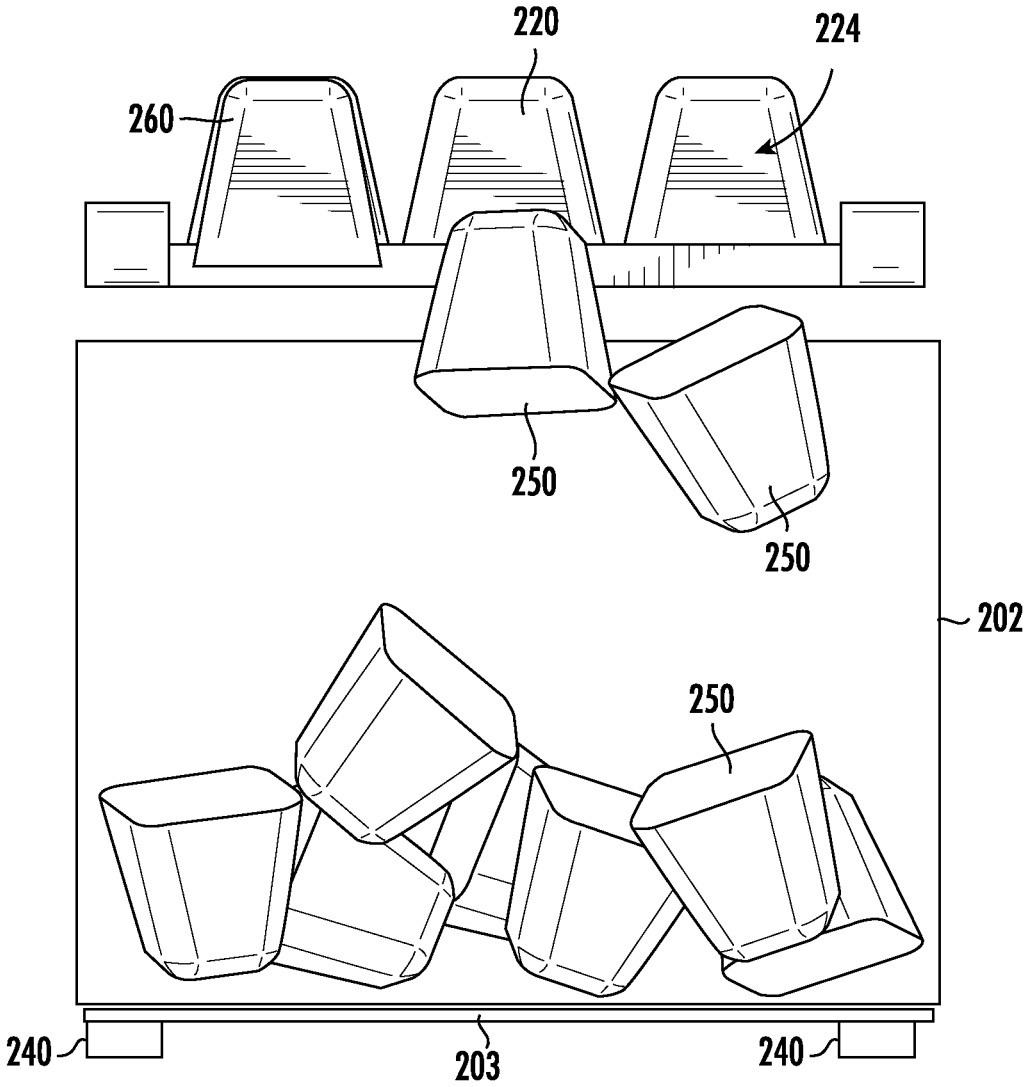
FIG. 7 provides a schematic illustration of the exemplary ice maker of FIG. 5 and an ice storage bin according to one or more embodiments of the present subject matter.

Referring now to FIG. 7, a schematic illustration of one exemplary embodiment of the ice tray 220 of the ice maker 200 and the ice storage bin 202 according to one or more exemplary aspects of the present subject matter is provided. As mentioned above, the ice tray 220 may define one or more compartments 224. In some embodiments, each compartment 224 may be configured to hold an ice piece. In some embodiments, the ice maker 200 may also include a harvest mechanism, for instance, a mechanism of the ice maker 200 that may be provided to harvest ice pieces from the ice tray 220. For example, the harvest mechanism of the ice maker 200 may be the actuation device 206. As described above, the actuation device 206 may twist the ice tray 220 to promote the release of ice pieces from the compartments 224. Furthermore, in some embodiments, the ice storage bin 202 may generally be provided to collect and store ice pieces, such as released ice pieces 250 described in more detail below, that may have been harvested, for example, released, from the ice tray 220.

Furthermore, the ice maker 200 may include a sensor assembly that may be attached to the ice storage bin 202. For instance, the sensor assembly may be attached to a bottom of the ice storage bin 202, such as attached directly to the bottom of the ice storage bin 202. For example, the sensor assembly may be attached to a bottom wall, or floor, of the ice storage bin 202.

Figure 8:
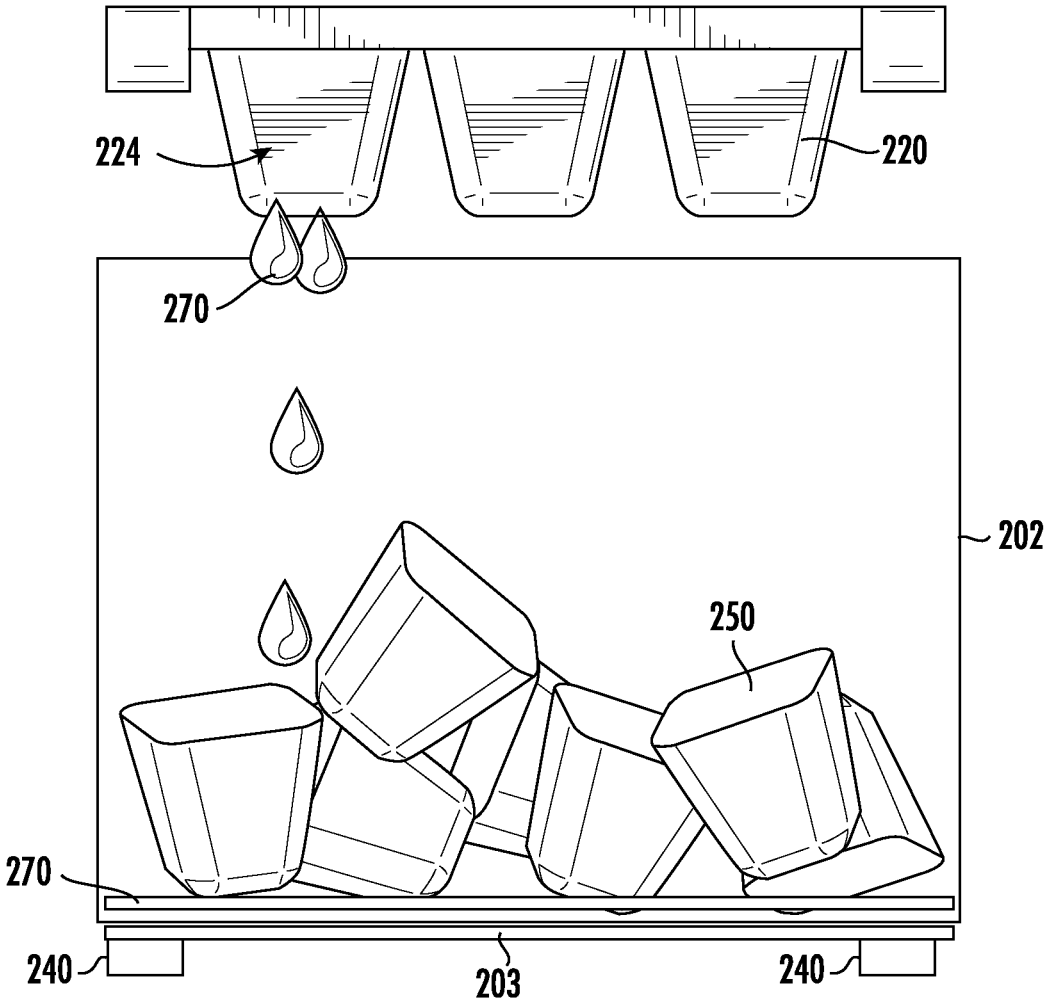
FIG. 8 provides an additional schematic illustration of the exemplary ice maker of FIG. 5 and the ice storage bin according to one or more embodiments of the present subject matter.

Optionally, in some embodiments, for example, as illustrated in FIGS. 7 and 8, a bucket holder 203 may be positioned below the ice storage bin 202. For instance, the bucket holder 203 may be positioned below the ice storage bin 202 to support the weight of the ice storage bin 202. For example, in some embodiments, the bucket holder 203 may be a component of the icebox 150 that may hold the ice storage bin 202 within the icebox 150. For instance, in some embodiments, the bucket holder 203 may be a surface within the icebox 150, for example, a plate or a shelf, that the ice storage bin 202 may be positioned on and supported by. Particularly, in some embodiments, ice storage bin 202 may be positioned directly on top of the bucket holder 203 such that the weight of the ice storage bin 202 may generally be supported by the bucket holder 203. In such embodiments, the sensors 240 of the sensor assembly may be attached to the bucket holder 203, such as attached to a bottom of the bucket holder 203.

The sensor assembly may be configured to sense conditions of the ice storage bin 202. For instance, the sensor assembly may include one or more sensors 240 that may be configured to sense conditions, for example, physical characteristics, of the ice storage bin 202. For example, in some embodiments, the sensors 240 may be weight sensors that may be configured to sense the weight of the ice storage bin 202. As another example, in some embodiments, the sensors 240 may be impact sensors that may be configured to sense impacts, for example, a force or shock applied to the ice storage bin 202 over a short period of time, such as when the released ice pieces 250 may contact the ice storage bin 202, or other released ice pieces 250 within the ice storage bin 202. As yet another example, the one or more sensors 240 may be any suitable combination of weight sensors and impact sensors. For instance, the sensor assembly may include one weight sensor and one impact sensor. Particularly, in some embodiments, the one or more sensors 240 may be one or more force sensitive resistors, one or more strain gauges, or a combination thereof.

It should be appreciated that only two sensors 240 may be included in exemplary embodiments of the present subject matter, for example, as illustrated in FIGS. 7 and 8. One of ordinary skill in the art would understand that the two sensors 240 are provided by way of example only. For instance, in additional or alternative exemplary embodiments any suitable number of sensors 240 may be attached to the ice storage bin 202. For example, only one sensor 240 may be attached to the ice storage bin 202. As another example, more than two sensors may be attached to the ice storage bin 202, for instance, three or more sensors 240 may be attached to the ice storage bin 202.

Moreover, in some embodiments, the controller 207 of the ice maker 200 may be capable of executing various system operations that may detect a failure mode of the ice maker 200. In some embodiments, the failure mode of the ice maker 200 may occur when the ice maker 200 may not be properly functioning. For example, a failure mode of the ice maker 200 may occur when an ice piece remains stuck within the ice tray 220, for example, when the ice piece may be frozen to the ice tray 220, such that it may not be released from the ice tray 220 during a normal harvest cycle. In this regard, the failure mode of the ice tray 220 may refer to the ice tray 220 not properly releasing ice pieces such that they may be collected within the ice storage bin 202. As another example, the failure mode of the ice maker 200 may refer to the ice tray 220 not being capable of properly forming ice pieces within the compartments 224 of the ice tray 220, for example, as a result of a crack in the ice tray 220 that may cause a leak of the ice tray 220.

In some embodiments, the controller 207 may be capable of executing a first system operation, wherein it may be detected if an ice piece has not been released from the respective compartment 224 of the ice tray 220. For example, the first system operation may detect ice pieces that may have become stuck to, for example, may have frozen to, the ice tray 220 such that they may not be released during the normal operation of the harvest mechanism, such as stuck ice piece 260.

For instance, during a harvest mode, for example, a mode of operation of the ice maker 200 wherein ice pieces that may have been formed within the compartments 224 of the ice tray 220 may be released from the ice tray 220, the sensor assembly may be configured to count similar impacts within the ice storage bin 202. For instance, the sensor assembly may include one or more sensors 240, for example, impact sensors, that may be configured to detect impacts of ice pieces that have been harvested from the compartments 224 of the ice tray 220, such as released ice pieces 250.

In some embodiments, an expected impact range may be known for a single released ice piece 250. For instance, the expected impact range for the single released ice piece 250 may correspond to a known range of force that a single released ice piece 250 may impart on the ice storage bin 202 when it may fall from the ice tray 220, for example, after it has been harvested from the ice tray 220. In some embodiments, the expected impact range may be based on the size of the released ice piece 250, and more particularly, may be based on the volume of liquid water that may have been used to fill the compartment 224 prior to the ice piece being formed. Furthermore, in some instances, the expected impact range may also be based on the remaining ice storage capacity of the ice storage bin 202. For example, as released ice pieces 250 are collected and stored within the ice storage bin 202, the remaining ice storage capacity may decrease as the released ice pieces 250 may occupy space within the ice storage bin 202. In this regard, the distance that the released ice pieces 250 may travel and the expected impact range that the released ice pieces 250 may impart on the ice storage bin 202 may also decrease as there may be less vertical space that the released ice pieces may have to fall.

In this regard, the one or more sensors 240 may be used to determine when a total ice piece number has been reached. In some embodiments, the total ice piece number may be the maximum number of ice pieces that may be released from the ice tray 220 and collected within the ice storage bin 202 during a single harvest cycle. For instance, the total ice piece number may generally correspond to the number of compartments 224 within the ice tray 220. For example, as illustrated schematically in FIG. 7, the ice tray 220 may include three compartments 224. Accordingly, the total ice piece number of the ice tray 220, for example, as illustrated schematically in FIG. 7, may be three ice pieces.

In some instances, the number of impacts detected by the impact sensor may be less than the total ice piece number. In such instances, one or more additional operations of the harvest mechanism may be performed in an attempt to release any stuck ice piece(s) 260, for example, an ice piece that may be stuck to, such as frozen to, the ice tray 220 such that it may not be released from the compartment 224 of the ice tray 220. For example, one or more additional operations of the actuation device 206 may be performed to twist the ice tray 220 in attempt to release any stuck ice piece(s) 260.

The harvest mechanism may perform additional operations until an impact, for example, an impact within the expected impact range, may be detected within the ice storage bin 202. In this regard, it may then be determined that the stuck ice piece 260 has been released from the ice tray 220, for instance, the stuck ice piece 260 may then be considered a released ice piece 250.

Moreover, in some embodiments, the harvest mechanism may only attempt to release the stuck ice piece(s) 260 for a designed number of attempts, for example, the actuation device 206 may only attempt to twist the ice tray 220 to remove the stuck ice piece(s) 260 for a predetermined number of rotations. In addition, in some embodiments, the harvest mechanism may only attempt to release the stuck ice pieces for a designed time, for example, the actuation device 206 may only attempt to twist the ice tray 220 to remove the stuck ice piece(s) 260 for a predetermined amount of time.

Additionally, in some embodiments, the controller 207 may also be capable of executing a second system operation, wherein it also may be detected if an ice piece has not been released from the respective compartment 224 of the ice tray 220. For example, the second system operation may also detect ice pieces that may have become stuck to, for example, may have frozen to, the ice tray 220 such that they may not be released during the normal operation of the harvest mechanism, such as stuck ice piece 260.

For instance, during a harvest mode, the one or more sensors 240 may be configured to sense the weight of the ice storage bin 202. For instance, the one or more sensor 240 may be a weight sensor that may be configured to weigh the ice storage bin 202. In some embodiments, an expected weight range may be known for a single released ice piece 250. For instance, the expected weight range for the single released ice piece 250 may correspond to a weight range for an ice piece that may be formed within the compartments 224 of the ice tray 220. In some embodiments, the expected weight range may be based on the size of the released ice piece 250, and more particularly, may be based on the volume of liquid water that may have been used to fill the compartment 224 prior to the ice piece being formed.

In this regard, the one or more sensors 240 may be used to determine an increase in the total weight of the ice storage bin 202. In some embodiments, the total weight of the ice storage bin 202 may be expected to have an increase in weight that may correspond to the total ice piece number. For instance, after each harvest cycle, the total weight of the ice storage bin 202 may be expected to increase by a weight that may correspond to the total ice piece number. For example, as illustrated in FIG. 7, the total ice piece number may be three ice pieces. In this regard, after each harvest cycle, the total weight of the ice storage bin 202 may be expected to increase by a weight that corresponds to three released ice pieces 250, for instance, the total weight of the ice storage bin 202 may be expected to increase by a weight, and more particularly a weight range, that may be equal to the summation of the weight ranges of the three released ice pieces 250.

In some instances, the increase in total weight of the ice storage bin 202 may be less than a weight that corresponds to the total ice piece number. In such instances, one or more additional operations of the harvest mechanism may be performed in an attempt to release any stuck ice piece(s) 260. For example, one or more additional operations of the actuation device 206 may be performed to twist the ice tray 220 in attempt to release any stuck ice piece(s) 260. The harvest mechanism may perform additional operations until the increase in total weight may approximately correspond to the total ice piece number. In this regard, it may then be determined that the stuck ice piece(s) 260 has been released from the ice tray 220, for instance, the stuck ice piece(s) 260 may then be considered released ice piece(s) 250.

Moreover, in some embodiments, the harvest mechanism may only attempt to release the stuck ice pieces for a designed number of attempts, for example, the actuation device 206 may only attempt to twist the ice tray 220 for a predetermined number of rotations. In addition, in some embodiments, the harvest mechanism may only attempt to release the stuck ice pieces for a designed time, for example, the actuation device 206 may only attempt to twist the ice tray 220 for a predetermined amount of time.

Further, in some embodiments, the controller 207 may be capable of executing a third system operation, wherein the controller 207 may continue the operation of the ice maker 200, and more particularly the harvest mechanism, despite unsuccessful attempts to release a stuck ice piece 260. For instance, the controller 207 may execute the third system operation after the harvest mechanism has attempted to release the stuck ice pieces for the designed number or the designed time, for example, after the first system operation or the second system operation.

In some embodiments, when the harvest of stuck ice pieces 260 has not been successful, a fill of liquid water may be provided to the compartments 224 that have successfully released an ice piece, for instance, empty compartments 224, such as compartments 224 that do not contain a stuck ice piece 260. In this regard, the ice maker 200 may continue to make ice pieces despite stuck ice piece(s) 260 being present in the ice tray 220. For example, it may be detected that a single compartment 224 of the three compartments 224 may contain a stuck ice piece 260. Accordingly, the controller 207 may be capable of filling the remaining two compartments 224 with liquid water such that additional ice pieces may be formed.

In some embodiments, the controller 207 may also be capable of executing a fourth system operation, wherein the controller 207 may suspend the operation of the harvest mechanism in response to unsuccessful attempts to release stuck ice piece(s) 260. For instance, the controller 207 may execute the fourth system operation when no ice pieces are released from the compartments 224 or one or more ice pieces are stuck within the compartments 224.

In some embodiments, in response to the operation of the harvest mechanism being suspended a user notification may be provided or transmitted, for example, to a display on the ice maker appliance and/or to a remote user interface device. For instance, the user notification may be a notification sent to a user's remote user interface device, for example, a user's smartphone, tablet, computer, smart watch, or any other device that may be connected to a network. In some embodiments, the notification may inform the user that one or more ice pieces may be stuck within the compartments 224 of the ice tray 220.

Additionally, in some embodiments, the controller 207 may be capable of executing a fifth system operation, wherein the volume of a fill of liquid water for the compartments 224 may be adjusted. For instance, during a harvest mode, the sensor 240 may be configured to sense the weight of the ice storage bin 202. For instance, the sensor 240 may be a weight sensor that may be configured to weigh the ice storage bin 202. In some instances, expected increase in weight of the ice storage bin 202 may increase by more than an expected weight that may correspond to the total ice piece number. In such instances, the volume of the fill of liquid water for the compartments 224 may be reduced such that the weight that may correspond to the total ice piece number may approximately reflect the expected increase in weight of the ice storage bin 202.

In some instances, cracks may form within the ice tray 220. For example, crack may form due to the repeated twisting of the ice tray 220, for instance, to release ice pieces from the compartments 224. These cracks may allow liquid water to leak from the ice tray 220. For instance, liquid water may leak from the ice tray 220 in the early stages of ice pieces forming, for example, after the compartments 224 have received a fill of liquid water. Accordingly, in some embodiments, the controller 207 may also be capable of executing a sixth system operation, wherein cracks within the ice tray 220 may be detected.

For example, referring now to FIG. 8, an additional schematic illustration of the ice tray 220 and the ice storage bin 202 of the ice maker 200 according to one or more additional exemplary aspects of the present subject matter is provided. Particularly, FIG. 8 illustrates liquid water 270 leaking from the ice tray 220, such as from a crack (not depicted) within the ice tray 220.

In some embodiments, as the fill of liquid water is flowing to the compartments 224 and prior to ice pieces freezing and forming within the compartments 224, the one or more sensors 240, for example, when the one or more sensor 240 may be one or more weight sensors, may be configured to sense an increase in total weight of the ice storage bin 202. In particular, FIG. 8 illustrates released ice pieces 250 that may have been collected within the ice storage bin 202 from one or more previous harvest cycles. Accordingly, the liquid water 270 may be present in the tray 220 during an early time period of a current operation cycle. For instance, the early time period may include during the fill and/or after the fill but before the liquid water 270 has been present in the compartments 224 of the ice tray 200 long enough to form into ice pieces. If it is sensed during this early time period that the total weight of the ice storage bin 202 increases, for example, the ice storage bin 202 is getting heavier, the operation of the ice maker 200 may be suspended. In some embodiments, in response to the operation of the ice maker 200 being suspended, a notification, for example, a user notification, may be provided or transmitted, for example, to a display on the ice maker appliance and/or to a remote user interface device. For instance, the user notification may be a notification sent to a user's remote user interface device, for example, a user's smartphone, tablet, computer, smart watch, or any other device that may be connected to a network. In some embodiments, the notification may inform the user that one or more of the compartments 224 may have a crack that is allowing liquid water 270 to leak from the compartments 224.

Figure 9:
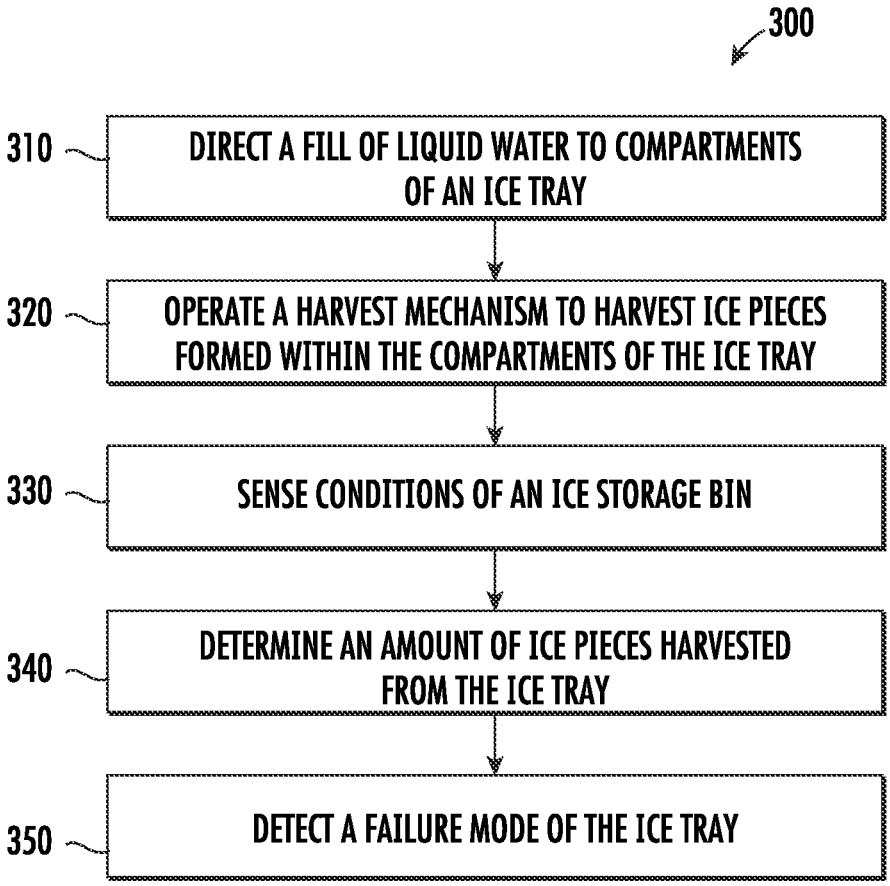
FIG. 9 provides a flow chart illustrating an exemplary method of operating an ice maker appliance according to one or more exemplary embodiments of the present subject matter.

Referring now to FIG. 9, embodiments of the present subject matter may include one or more methods for operating an ice maker appliance, such as the exemplary ice maker 200 described above, as well as other possible exemplary ice maker appliances. The exemplary methods according to the present subject matter may include a method 300, for example, as illustrated in FIG. 9. A controller of the ice maker appliance, such as the controller 207 of the exemplary ice maker 200, may be programmed to implement method 300, for example, the controller, such as controller 207, may be capable of and may be operable to perform any methods and associated method steps as disclosed herein.

In some embodiments, the method 300 may include a step 310 of directing a fill of liquid water to compartments of an ice tray. For instance, in some embodiments, the ice maker may include or be provided with a water line which may be positioned and configured to direct a flow of the fill of liquid water to the ice tray of the ice maker, for example, the flow of the fill of liquid water may be directed towards or into the compartments 224 of the ice tray 220. The compartments may retain the fill of liquid water in order to form ice pieces, such as ice cubes, ice gems, etc., therein.

Furthermore, the method may also include a step 320 of operating a harvest mechanism to harvest ice pieces formed within the compartments of the ice tray. In some embodiments, the harvested ice pieces may be collected within the ice storage bin. For instance, as described above, the harvest mechanism may be a mechanism of the ice maker that may be provided to harvest ice pieces from the ice tray. For example, in some embodiments wherein the ice tray is a twist ice tray, such as described above with reference to FIGS. 5 and 6, operating the harvest mechanism may include twisting the ice tray to release ice pieces that may have formed within the compartments of the ice tray.

The method may further include a step 330 of sensing, with a sensor assembly, conditions of an ice storage bin. In some embodiments, the sensor assembly may include an impact sensor. In such embodiments, the step 330 of sensing, with a sensor assembly, conditions of an ice storage bin may include a step of sensing, with the impact sensor, impacts within the ice storage bin. For example, when a released ice piece may contact the ice storage bin, for instance, the bottom wall or floor of the ice storage bin, the impact may be sensed. Furthermore, each impact sensed may include force data. The force data may be the sensed force that the released ice piece exerted on the ice storage bin upon its impact. Thus, in some embodiments, the step 330 of sensing, with a sensor assembly, conditions of an ice storage bin may further include a step of counting a number of impacts which have force data within a predetermined force range. Generally, the force range of an impact may be known as the ice pieces are expected to be the same size and fall from approximately the same height. Accordingly, the predetermined force range may be based on the size of the ice pieces and the height of the ice pieces relative to the ice storage bin. Moreover, in some instances, the counted number of impacts may be less than a total ice piece number, for example, a number of ice pieces that may directly correspond to the number of compartments defined by the ice tray. In such instances, the step 330 of sensing with a sensor assembly, conditions of an ice storage bin may further include a step of operating the harvest mechanism to harvest ice pieces stuck within the compartments of the ice tray.

Additionally, or alternatively, in some embodiments, the sensor assembly may include a weight sensor. In such embodiments, the step 330 of sensing, with a sensor assembly, conditions of an ice storage bin may include a step of sensing, with the weight sensor, a total weight of the ice storage bin. For instance, when a released ice piece may be collected within the ice storage bin, the weight of the ice piece may increase the total weight of the ice storage bin. In some instances, the total weight of the ice storage bin may be less than an expected weight. As the total ice piece number may be known, the expected increase in total weight after a single harvest cycle, for example, after all ice pieces have been released from the ice tray, may also be known. Thus, in some embodiments, the step 330 of sensing, with a sensor assembly, conditions of an ice storage bin may further include a step of operating the harvest mechanism to harvest ice pieces stuck, for example, stuck ice piece(s) 260, within the compartments of the ice tray.

Alternatively, in some instances, the total weight of the ice storage bin may be greater than the expected weight. Thus, in some embodiments, the step 330 of sensing, with a sensor assembly, conditions of an ice storage bin may further include a step of reducing a volume of a second fill of liquid water. For instance, the second fill of liquid water may be a fill of liquid water that is flowed to the compartments of the ice tray in subsequent harvest cycles of the ice maker. Moreover, in instances when the total weight of the ice storage bin may be greater than the expected weight it may be determined that each individual ice piece may have a larger size, for instance, a greater weight than desired.

Furthermore, in some embodiments, the method may also include a step 340 of determining, based on the sensed conditions of the ice storage bin, an amount of ice pieces harvested from the ice tray. For instance, based on conditions such as the total weight of the ice storage bin or impacts sensed within the ice storage bin, an amount of ice pieces, such as the number of ice pieces, harvested from the ice tray and collected within the ice storage bin may be determined.

The method may further include a step 350 of detecting, based on the determined amount of ice pieces harvested, a failure mode of the ice tray. As mentioned above, the failure mode of the ice tray may generally be detected when the ice tray is not properly or successfully harvesting ice pieces from the ice tray. In some embodiments, in response to a failure mode being detected the method may include a step of operating the harvest mechanism to harvest ice pieces stuck within the compartments of the ice tray. This may include a step of directing a second fill of liquid water to an open compartment of the ice tray.

In addition, in response to a failure mode being detected the method may include a step of suspending operation of the harvest mechanism. Furthermore, in response to suspending operation of the harvest mechanism, the method may include a step of and providing a user notification, for example, to a display on the ice maker appliance and/or to a remote user interface device in response to suspending operation of the harvest mechanism in response to the failure mode being detected. For example, in embodiments where the ice maker appliance is a refrigerator appliance having an ice maker therein, such as refrigerator appliance 100, the controller 207 of the ice maker 200 may communicate with the controller 164 of the refrigerator appliance 100 whereby the user notification may be displayed on a user interface of the refrigerator appliance 100, such as on display 166 (FIG. 1). In exemplary embodiments where the user notification is also or instead provided on the remote user interface device, the remote user interface device may be any suitable device such as a laptop computer, smartphone, tablet, personal computer, wearable device, smart speaker, smart home system, and/or various other suitable devices. The remote user interface device is "remote" at least in that it is spaced apart from and not physically connected to the ice maker appliance, e.g., the remote user interface device is a separate, stand-alone device from the ice maker appliance which communicates with the ice maker appliance wirelessly, e.g., through various possible communication connections and interfaces such as WI-FI®. The ice maker appliance and the remote user interface device may be matched in wireless communication, e.g., connected to the same wireless network. The ice maker appliance may communicate with the remote user interface device via short-range radio such as BLUETOOTH® or any other suitable wireless network having a layer protocol architecture. Any suitable device separate from the ice maker appliance that is configured to provide and/or receive communications, information, data, or commands from a user may serve as the remote user interface device, such as a smartphone, smart watch, personal computer, smart home system, or other similar device. For example, the remote user interface device may be a smartphone operable to store and run applications, also known as "apps," and some or all of the method steps disclosed herein may be performed by a smartphone app. For example, the user notification may be or include an email, a text message, and/or other suitable notifications via a remote user interface device.

Moreover, in some embodiments, the method 300 may additionally include a step of determining, based on the sensed conditions of the ice storage bin, that at least a portion of the fill of liquid water escaped from the compartments of the ice tray. This may include a step of sensing, with a weight sensor of the sensor assembly, the weight of the ice storage bin. Furthermore, this may also include a step of determining, based on the sensed weight of the ice storage bin, a change in the weight of the ice storage bin. In addition, in response to determining that at least a portion of the fill of liquid water escaped from the compartments of the ice tray, method 300 may further include a step of providing a user notification, for example, to a display on the ice maker appliance and/or to a remote user interface device in response to suspending operation of the harvest mechanism in response to it being determined that a least a portion of the fill of liquid water escaped from the compartments of the ice tray Embodiments of the present subject matter may advantageously improve the operation of an ice maker appliance. For instance, the ice maker appliance may advantageously be configured to detect ice tray failures and water leakage. Additionally, the ice maker appliance may advantageously be configured to notify a user in response to such failures and leaks being detected. Moreover, as explained herein, aspects of the present subject matter are generally directed to systems and methods for detecting ice piece release failures and ice tray failures by utilizing weight sensors, impact sensors, or a combination thereof. The sensors may generally be positioned beneath the ice storage bin to detect the amount of ice pieces that may be in the ice storage bin. Particularly, the sensors may be any type, style, or model of impact sensors that may detect the impact of ice pieces or the weight of the ice storage bin.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating an ice maker appliance, the method comprising:

directing a fill of liquid water to compartments of an ice tray;

operating a harvest mechanism to harvest ice pieces formed within the compartments of the ice tray, whereby harvested ice pieces are collected within an ice storage bin;

sensing, with a sensor assembly, conditions of the ice storage bin;

determining, based on the sensed conditions of the ice storage bin, that at least a portion of the fill of liquid water escaped from the compartments of the ice tray;

determining, based on the sensed conditions of the ice storage bin, an amount of ice pieces harvested from the ice tray; and detecting, based on the determined amount of ice pieces harvested, a failure mode of the ice tray.

2. The method of claim 1, wherein the sensor assembly comprises an impact sensor and wherein sensing, with the sensor assembly, conditions of the ice storage bin comprises sensing, with the impact sensor, impacts within the ice storage bin.

3. The method of claim 2, wherein each impact sensed comprises force data, further comprising counting a number of impacts which have force data within a predetermined force range.

4. The method of claim 3, wherein the counted number of impacts is less than a total ice piece number, further comprising operating the harvest mechanism to harvest ice pieces stuck within the compartments of the ice tray.

5. The method of claim 1, wherein the sensor assembly comprises a weight sensor and wherein sensing, with the sensor assembly, conditions of the ice storage bin comprises sensing, with the weight sensor, a total weight of the ice storage bin.

6. The method of claim 5, wherein the sensed total weight of the ice storage bin is less than an expected weight, further comprising operating the harvest mechanism to harvest ice pieces stuck within the compartments of the ice tray.

7. The method of claim 5, wherein the sensed total weight of the ice storage bin is greater than an expected weight, further comprising reducing a volume of a second fill of liquid water.

8. The method of claim 1, further comprising operating the harvest mechanism to harvest ice pieces stuck within the compartments of the ice tray in response to the failure mode being detected.

9. The method of claim 8, further comprising directing a second fill of liquid water to an open compartment of the ice tray.

10. The method of claim 1, further comprising suspending operation of the harvest mechanism and providing a user notification in response to suspending operation of the harvest mechanism in response to the failure mode being detected.

11. The method of claim 1, wherein determining that at least a portion of the fill of liquid water escaped from the compartments of the ice tray comprises sensing, with a weight sensor of the sensor assembly, the weight of the ice storage bin and determining, based on the sensed weight of the ice storage bin, a change in the weight of the ice storage bin.

12. The method of claim 1, further comprising providing a user notification in response to determining that at least a portion of the fill of liquid water escaped from the compartments of the ice tray.

13. An ice maker appliance, the ice maker appliance comprising:

an ice tray defining one or more compartments, wherein each compartment is configured to hold an ice piece;

a harvest mechanism configured to harvest ice pieces from the ice tray;

an ice storage bin provided to collect ice pieces harvested from the ice tray;

a sensor assembly attached to the ice storage bin, whereby conditions of the ice storage bin are sensed by the sensor assembly; and a controller, the controller operable for:

directing a fill of liquid water to the one or more compartments of the ice tray;

operating the harvest mechanism to harvest ice pieces formed within the one or more compartments of the ice tray;

sensing, with the sensor assembly, conditions of the ice storage bin;

determining, based on the sensed conditions of the ice storage bin, that at least a portion of the fill of liquid water escaped from the compartments of the ice tray;

determining, based on the sensed conditions of the ice storage bin, an amount of ice pieces harvested from the ice tray; and detecting, based on the determined amount of ice pieces harvested, a failure mode of the ice tray.

14. The ice maker appliance of claim 13, wherein the sensor assembly is attached directly to a bottom of the ice storage bin.

15. The ice maker appliance of claim 13, wherein a bucket holder is positioned below the ice storage bin and wherein the sensor assembly is attached to the bucket holder.

16. The ice maker appliance of claim 13, wherein a weight of the ice storage bin and impacts within the ice storage bin are each sensed by the sensor assembly.

17. The ice maker appliance of claim 16, wherein the sensor assembly comprises a force sensitive resistor, a strain gauge, or a combination thereof.

18. The ice maker appliance of claim 13, wherein the harvest mechanism is an actuation device, wherein the actuation device may rotate the ice tray to twist the ice tray, whereby ice pieces formed within the compartments of the ice tray are harvested from the ice tray.

* * * * *